US008757679B2

(12) United States Patent
Torkowski et al.

(10) Patent No.: US 8,757,679 B2
(45) Date of Patent: Jun. 24, 2014

(54) CLOSING DEVICE COMPRISING TWO PAWLS AND A MOTOR-DRIVEN ACTUATING MECHANISM

(75) Inventors: Thorsten Torkowski, Bergisch-Gladbach (DE); Karsten Barth, Hattingen (DE); Serkan Gülkan, Hattingen (DE); Ulrich Weichsel, Duisburg (DE); Thorsten Bendel, Oberhausen (DE); Kevin Zhang, Shanghai (CN)

(73) Assignee: Kiekert AG, Heiligenhaus (DE)

( * ) Notice: Subject to any disclaimer, the term of this patent is extended or adjusted under 35 U.S.C. 154(b) by 592 days.

(21) Appl. No.: 12/997,588

(22) PCT Filed: May 26, 2009

(86) PCT No.: PCT/DE2009/000738

§ 371 (c)(1),
(2), (4) Date: Mar. 9, 2011

(87) PCT Pub. No.: WO2009/149684

PCT Pub. Date: Dec. 17, 2009

(65) Prior Publication Data

US 2011/0204690 A1 Aug. 25, 2011

(30) Foreign Application Priority Data

Jun. 13, 2008 (DE) ..... 10 2008 028 256

(51) Int. Cl.
*E05C 3/06* (2006.01)
*E05C 3/16* (2006.01)

(52) U.S. Cl.
USPC ..... 292/201; 292/216; 292/DIG. 23; 296/65.17; 297/378.13

(58) Field of Classification Search
USPC ..... 292/201, 216, DIG. 23, 332, 336; 297/378.12, 378.13
See application file for complete search history.

(56) References Cited

U.S. PATENT DOCUMENTS

| | | | | | |
|---|---|---|---|---|---|
| 4,669,283 | A | * | 6/1987 | Ingenhoven | 70/264 |
| 4,674,781 | A | * | 6/1987 | Reece et al. | 292/336.3 |
| 5,137,312 | A | * | 8/1992 | Tang | 292/336.3 |
| 5,273,324 | A | * | 12/1993 | Kobayashi | 292/201 |
| 5,373,752 | A | * | 12/1994 | Schlagwein | 74/89.38 |
| 5,526,710 | A | * | 6/1996 | Ohta | 74/89 |
| 5,537,848 | A | * | 7/1996 | Grzanka et al. | 70/279.1 |
| 5,584,206 | A | * | 12/1996 | Ohta | 74/89 |

(Continued)

FOREIGN PATENT DOCUMENTS

| | | | |
|---|---|---|---|
| DE | 197 36 445 | A1 | 2/1998 |
| DE | 1990256 | A1 * | 8/2000 |

(Continued)

*Primary Examiner* — Carlos Lugo
*Assistant Examiner* — Alyson M Merlino
(74) *Attorney, Agent, or Firm* — Renner, Otto, Boisselle & Sklar, LLP

(57) ABSTRACT

A locking device (1) comprising at least one locking mechanism (2) having a catch (3), a pivotal first pawl (4), and a second pawl (5), with which the first pawl (4) can be blocked from being swiveled. The locking device (1) further comprises a motor-driven actuating mechanism (6), which displaces at least one operating lever (7) in such a manner that the operating lever (7), during its movement cooperates with both pawls (4, 5) one after the other. The locking device is used to lock or unlock seat backs of motor vehicles.

18 Claims, 5 Drawing Sheets

(56) References Cited

U.S. PATENT DOCUMENTS

| | | | | |
|---|---|---|---|---|
| 6,428,058 | B1 * | 8/2002 | Graute | 292/216 |
| 6,519,986 | B2 * | 2/2003 | Wicker | 70/237 |
| 6,520,548 | B1 * | 2/2003 | Fisher et al. | 292/201 |
| 6,540,271 | B1 * | 4/2003 | Kalsi | 292/216 |
| 6,540,272 | B2 * | 4/2003 | Spurr | 292/216 |
| 6,575,507 | B2 * | 6/2003 | Reddmann | 292/216 |
| 6,601,883 | B1 * | 8/2003 | Kalsi | 292/216 |
| 6,773,042 | B2 * | 8/2004 | Spurr et al. | 292/216 |
| 6,866,311 | B2 * | 3/2005 | Spurr et al. | 292/216 |
| 6,883,839 | B2 * | 4/2005 | Belmond et al. | 292/201 |
| 6,932,393 | B2 * | 8/2005 | Erices | 292/216 |
| 7,325,843 | B2 * | 2/2008 | Coleman et al. | 292/216 |
| 7,568,740 | B2 * | 8/2009 | Brose et al. | 292/216 |
| 8,235,428 | B2 * | 8/2012 | Hunt et al. | 292/216 |
| 2001/0048227 | A1 * | 12/2001 | Kachouh | 292/216 |
| 2004/0094971 | A1 * | 5/2004 | Warmke et al. | 292/201 |
| 2005/0082842 | A1 * | 4/2005 | Warmke et al. | 292/216 |
| 2006/0006671 | A1 * | 1/2006 | Noel et al. | 292/216 |
| 2006/0006673 | A1 * | 1/2006 | Christoffel et al. | 292/216 |
| 2006/0076784 | A1 * | 4/2006 | Kachouh et al. | 292/216 |
| 2007/0158954 | A1 * | 7/2007 | Warmke et al. | 292/201 |
| 2008/0224482 | A1 * | 9/2008 | Cumbo et al. | 292/216 |
| 2010/0052336 | A1 * | 3/2010 | Bendel et al. | 292/196 |
| 2010/0052341 | A1 * | 3/2010 | Taurasi et al. | 292/304 |
| 2010/0127511 | A1 * | 5/2010 | Vasquez et al. | 292/201 |
| 2011/0089705 | A1 * | 4/2011 | Barth et al. | 292/226 |

FOREIGN PATENT DOCUMENTS

| | | | |
|---|---|---|---|
| DE | 102 36 282 | A1 | 3/2003 |
| DE | 10 2007 048 228 | A1 | 2/2008 |
| DE | 102007003948 | * | 5/2008 |

* cited by examiner

CLOSING DEVICE COMPRISING TWO PAWLS AND A MOTOR-DRIVEN ACTUATING MECHANISM

CROSS-REFERENCE TO RELATED APPLICATIONS

This is a National Stage Application of International Patent Application No. PCT/DE2009/000738, with an international filing date of May 26, 2009, which is based on German Patent Application No. 10 2008 028 256.1, filed Jun. 13, 2008.

BACKGROUND OF THE INVENTION

1. Field of the Invention

The present invention relates to a locking device comprising at least one locking mechanism with a catch, a pivotal first pawl, and a second pawl, wherein the pivoting of the first pawl can be blocked by the second pawl. Thus, the invention relates in particular to a locking system preferably with an electrically-openable locking mechanism comprising a catch and at least two pawls, preferably for locking and unlocking of the seat backrests in motor vehicles, especially for backrests of folding rear seats.

2. Brief Description of the Related Art

Locks for motor vehicle doors with a locking mechanism comprising a catch and a pawl, frequently include a locking mechanism in which the pawl (and often also a second pawl) is supported by or blocked by a blocking lever. At the same time, the blocking lever usually has the purpose of increasing the safety of the lock against accidental opening or intrusion. In other locking mechanisms with two pawls, the main focus is on providing a low-noise opening (to avoid a so-called audible opening snap).

Moreover, in the field of motor vehicle locks a lock maybe used (a servo lock) to lift the pawl by means of a motor in order to open the locking mechanism. Usually, an electric motor is used for this purpose. Therefore, a motor vehicle user only needs to apply a small opening force to the inner or outer actuating lever to initiate the motor-driven opening of the locking mechanism.

In addition, it is generally known that locking systems with locking mechanisms are used in other parts of motor vehicles, for example, in trunk lids, tank doors, and the like.

Although the development of vehicle door closure systems is already well advanced, especially since a large number of electrical appliances and functions have already been integrated into vehicle doors, the forms of locking devices for other parts of motor vehicles have so far been kept as simple as possible. This has been done to achieve a long service lifetime of the closing systems during frequent use, especially in view of usually difficult accessibility.

BRIEF DESCRIPTION OF THE INVENTION

On this basis, it is the task of the present invention to provide a locking device that solves the prior art problems, at least partially. In particular, considered are locking devices that can be used for locking and unlocking seat backrests in motor vehicles. In connection herewith, a comfortable and safe operation of the seats is to be guaranteed, while at the same time the safety criteria are particularly taken into account. In addition, the locking device occupies only a small space, produced low audible noise, and provides a fast response time.

SUMMARY OF THE INVENTION

These tasks are achieved with a locking device having the features as described in claim 1. Advantageous embodiments of the locking device are given in the dependent claims. It should be noted that individually listed features in the claims may be combined in any technologically sensible way and to show further embodiments of the invention. The description, particularly in relation to the figures, further illustrates the invention and shows additional examples.

The inventive locking device described herein comprises at least a locking mechanism with a catch, a pivotal first pawl, and a second pawl, wherein the second pawl can block the pivoting movement of the first pawl. The locking device further comprises a motor-driven actuator that moves at least an operating lever so that the operating lever cooperates during its movement with both of the pawls in succession.

It is a particular objective of the invention that each of the two pawls produces low audible noise levels during actuation with the aim of safely lifting the catch.

The locking mechanism preferably comprises at least three parts. The catch is rotatable about an axis of rotation, it can be spring-loaded, and it has an inlet opening through which it can receive a latch pin. The position of the latch pin is fixed in the locking device by pivoting the catch. In order to prevent the catch from being again pivoted to the open position, the catch is locked in place by the first pawl. To this end, the first pawl is disposed about another pivot point and comes into contact with the periphery of the catch. In this way, the first pawl exerts a force on the catch, which prevents the rotation of the catch into the open position. This contact between the catch and the pawl is preferably such that the force is not transferred through the pivot point of the first pawl, but such that a moment is provided in which the catch pushes away the first pawl in a spring-loaded rotation in the direction of the open position. In order to ensure a secure latching of the catch, the first pawl is blocked with a second pawl.

This second pawl is also mounted rotatably. The pivot points of the catch, of the first pawl, and of the second pawl substantially form a triangle. The first pawl extends onto the line connecting the pivot point of the catch and the pivot point of the second pawl and is blocked in that position.

Basically, it would also be possible to drive such a locking device purely mechanically, for example, using appropriate levers and/or Bowden cables that lead to a handle that can be actuated by a user. However, it is proposed to use a motor-driven actuator. This means, in particular, that the movement of the operating lever is brought about by a motor. The motor is controlled appropriately to accomplish this, wherein different buttons, sensors, or other detection means are implemented to realize the door opening. With the provision of a motor-driven actuator, the actuators can be safely accommodated in confined spaces. In addition, this improves the convenience of the operation of the locking device and also reduces the noise level.

The actuator moves the operating lever so that the pawls are successively (in time) actuated and released. In particular, the operating lever is pivoted about the pivot point. In particular, during the opening of the locking mechanism, the second pawl is first pivoted by the operating lever, thereby lifting the blockade of the first pawl. At a later point in time, particularly after a period of time has elapsed since the first pawl was unblocked, the operating lever is brought into contact with the other pawl, namely the first pawl, so that the first pawl is (further) pivoted by the operating lever.

Continuing with the design, it is proposed to outfit the actuator with an electric motor having an output shaft and a drive wheel that cooperates with the output shaft. The electric motor is contacted with a suitable controller and power supply so that it can be set in motion on demand. The torque generated by the electric motor is transmitted via an output shaft, for example, with a worm wheel, onto a drive wheel having, for example, external tooting. The rotatably-disposed drive wheel includes means for interacting with the operating lever and for putting the drive wheel into a desired motion. It is preferred that the output shaft and the drive wheel are plastic and/or formed from sound absorbing materials.

Moreover, it is regarded as advantageous in this context that the drive wheel forms a common bearing with the first pawl or with the second pawl. In other words, the first pawl and the drive wheel are rotatable, for example, on a common rotational axis or a shaft socket that is formed there. Alternatively, this can be formed in the same way in combination with the second pawl. In this way, an aimed intervention into the movements of the first pawl and/or the second pawl can be made through the operating lever. Moreover, a space-saving arrangement of the components is achieved for the locking device.

In addition, it is deemed preferable to provide a drive wheel that is formed as a single part in conjunction with the operating lever. Thus, in particular, the number of parts can be reduced. It is also possible to use noise-insulating materials. Optionally, a motion damper can be placed between the operating lever and the drive wheel, for example, in the manner of a one-piece flexible or compressible portion of the components. In addition, production from material is preferred in a manufacturing process. It is preferred that the drive wheel and the operating lever form a common bearing with the first pawl or with the second pawl, wherein the drive wheel is disposed above the operating lever and the operating lever is disposed above the respective pawl.

According to a further embodiment, the drive wheel is designed with a reset spring. This means, in particular, that the movement of the drive wheel with the electric motor is carried out against the force of the reset spring. Thus, when the electric motor completes its operation, the reset spring initiates a return movement of the drive wheel and, in this way, also initiates a return movement of the drive shaft of the motor. In this way, the motor-driven actuator is returned to its initial state in a particularly simple way, wherein this way at least partially coincides in time with the closing movement of the locking device. Thus, a noise-causing reset of the electric motor can be avoided and, in the same way, the functionality of the motor-driven actuator for opening the locking mechanism can be restored.

According to a further embodiment, the second pawl has a blocking leg for the first pawl, a stop leg for a pivot limiter, and a driver leg for the operating lever. It is preferred that the second pawl has a metal base body and that at least the blocking leg in the contact area toward the first pawl is likewise outfitted with a metallic surface. In contrast, it is preferred that the stop leg and the driver leg are provided with a damping material so that the contact between these legs and the pivot limiter and/or the operating lever, respectively, is as quiet as possible. It is preferred that the stop leg and the driver leg are located substantially opposite from one another with respect to the pivot point of the second pawl, while the blocking leg is sandwiched between them on the side toward the first pawl. The pivot limiter can be, for example, fixed to the housing of such a locking device and optionally also serve as an attachment position for the reset spring, for example, the rest spring for the second pawl.

In addition, it is suggested that the operating lever is plastic. This not only has the advantage that relatively small forces are required for the movement of the operating lever, but also that the operating lever acts as a low-audible noise facilitator for the movements of the two pawls. Consequently, it is possible to provide the pawls with a smaller profile, thereby reducing the manufacturing cost and size of such pawls. The contact between plastic and metal allows for low-noise operation of the locking device.

It is also considered that the locking mechanism is preferably disposed in a first plane, the release lever is disposed in a second plane, and the actuator is disposed in a third plane, and that the components disposed in the adjacent planes interact by means of at least one drive pin. Such a compact design of the locking device allows, for example, for the integration of the locking device in a single housing or in a common casing cover. Starting from the housing base plate, the locking mechanism is arranged, for example, in the first plane. The locking mechanism comprises the catch and the two pawls. A level above, i.e., in the second level, is provided the operating lever. The operating lever comprises in this case one or more drive pins. The one or more drive pins extends down into the first level, and particularly contacts the first pawl and the second pawl. Of course, the operating lever may comprise many drive pins. It is also possible that at least a pawl comprises a drive pin, which interacts with the periphery of the release lever. The actuator is located further up on the third level. Thus, the actuator covers at least in part the release lever in the second level and a part of the locking mechanism in the first level. Most particularly preferred is the embodiment in which the actuator is provided with a drive wheel and in which the first pawl, the operating lever, and the drive wheel are disposed on a common axis of rotation.

In addition, it is considered advantageous that the operating lever and the first pawl share a common bearing. This can also be provided particularly when the drive wheel of the actuator and the second pawl share a common bearing.

In yet another embodiment of the locking device, the catch comprises a projection, and the first pawl comprises a recess for receiving the projection. Conventionally, the catch is formed with a portion that is used (at its one side) for interacting with the first pawl. Here, it is suggested, however, to use a kind of (two-sided) circumvallation of the projection of the catch (with a little play). To this end, the pawl is provided with a relatively large recess, the recess being formed in particular in a U-shaped portion of the first pawl. The recess ensures a particularly secure reception of the catch in the first pawl, so that the movement of the catch is blocked by the first pawl in both directions of rotation.

The invention finds particular application in a motor vehicle having a seat with a folding backrest, wherein the backrest can be locked in one position with the locking device of this invention. The seat is in particular a rear seat, which has a folding backrest to enable access to the trunk or the rear of the vehicle. To this end, the locking device is attached to the backrest, the seat, or a fastening member of the vehicle body and interacts with a latch pin, which is attached to another one of the aforementioned components.

The invention and the technical background are explained in more detail hereinbelow with reference to the figures. It should be noted that the figures show particularly preferred embodiments of the invention, but the invention is not limited to these embodiments.

DETAILED DESCRIPTION OF THE INVENTION

Figure 1:
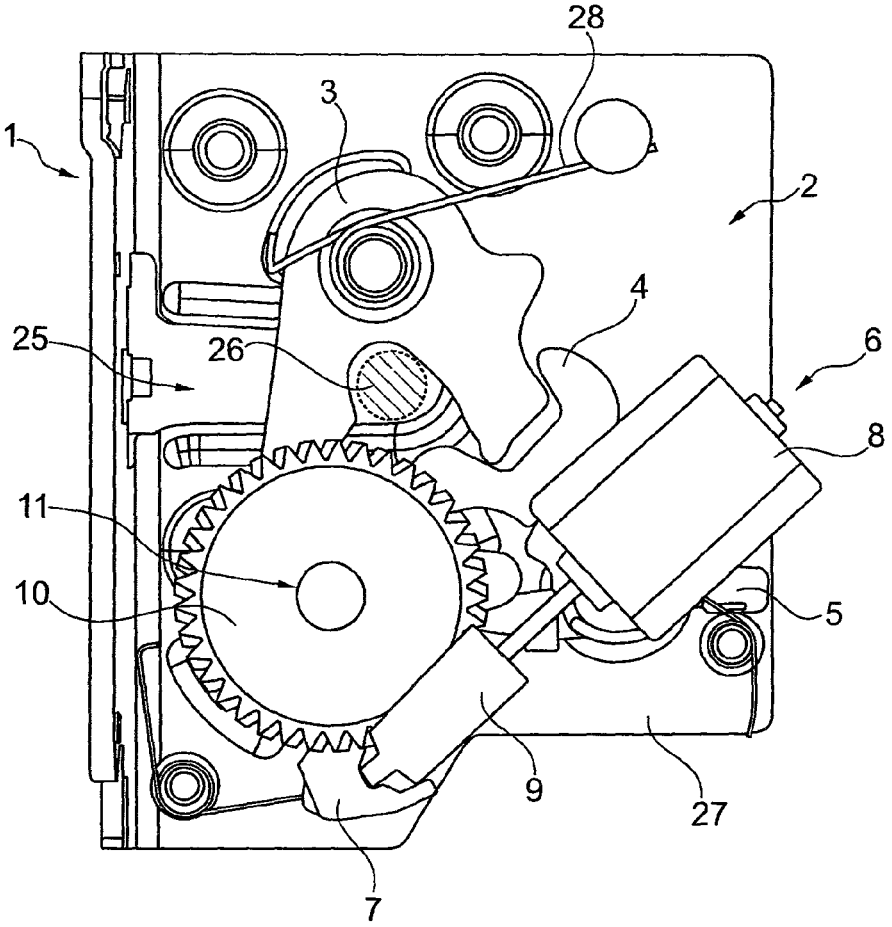
FIG. 1 shows a first embodiment of a locking device in a plan view in a closed position.

FIG. 1 shows a locking device 1, in which a locking mechanism 2 is implemented with a catch 3 and two pivoting pawls, namely the first pawl 4 and the second pawl 5. These three components are rotatably fixed on a base plate of the housing 27. Shown here is a plan view of a locking device 1, wherein the cover has been omitted. In the housing 27, an inlet 25 can be seen, which can receive the latch pin 26. In the locked position, the latch pin 26 is enclosed by the rotatable catch 3, so that the latch pin can no longer leave the inlet 25. The catch 3 is biased by the spring element 28 and, therefore, seeks to swing back (here, clockwise) into the open position. In addition, it should be noted that seat cushions, seals, and the like are usually found between the locking device and the component to be locked, so that the latch pin 26 also exerts a reset force on the catch 3.

A pawl 4 is provided in order to prevent the catch 3 from pivoting back to the open position. The pawl 4 engages the catch 3 partially and blocks the catch with respect to its opening movement. The first pawl 4 is mounted on the bearing 11 on the housing 27. On the side of the first pawl 4 and opposite to the catch 3 is positioned the second pawl 5. The second pawl 5 is partially covered by the electric motor 8, which lies above it. The electric motor 8 is a part of the actuator 6. The interaction of the catch 3, the first pawl 4, and the second pawl 5 will be explained in detail below.

An operating lever 7 is provided at the bearing 11 above the first pawl 4. The function thereof is described in detail below. Also attached to this bearing 11 is a drive wheel 10 of the actuator 6, which is located above the operating lever 7. The electric motor 6 comprises an output shaft 9 in the form of a worm pinion, which cooperates with the tooting on the periphery of the drive wheel 10.

Figure 2:
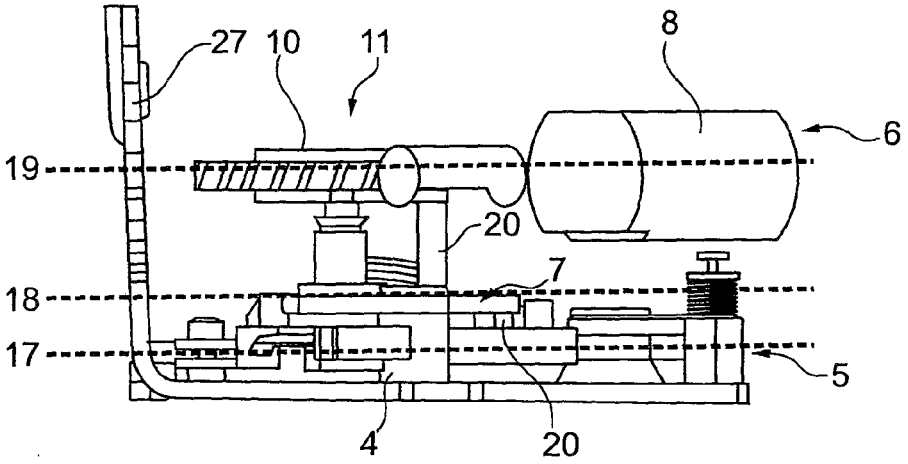
FIG. 2 shows the locking device of FIG. 1 in a side view.

FIG. 2 shows a side view of the locking device 1 shown in FIG. 1, wherein the figure shows three levels starting from the bottom of the housing 27. Near the housing 27 is first shown the first level 17, in which the locking mechanism 2 is arranged and comprises the two pawls 4, 5, and the catch 3. A level above, i.e., on the second level 18, is provided the operating lever 7. Further up is the third level, marked 19, which accommodates members of the actuator 6. The left side in FIG. 2 shows that a common bearing 11 is provided for the first pawl 4, the operating lever 7, and the drive wheel 10. The drive wheel 10 and the operating lever 7 are also (partially) movably-connected with one another by a drive pin 20, just as is the case for the operating lever 7 and the second pawl 5.

Figure 3:
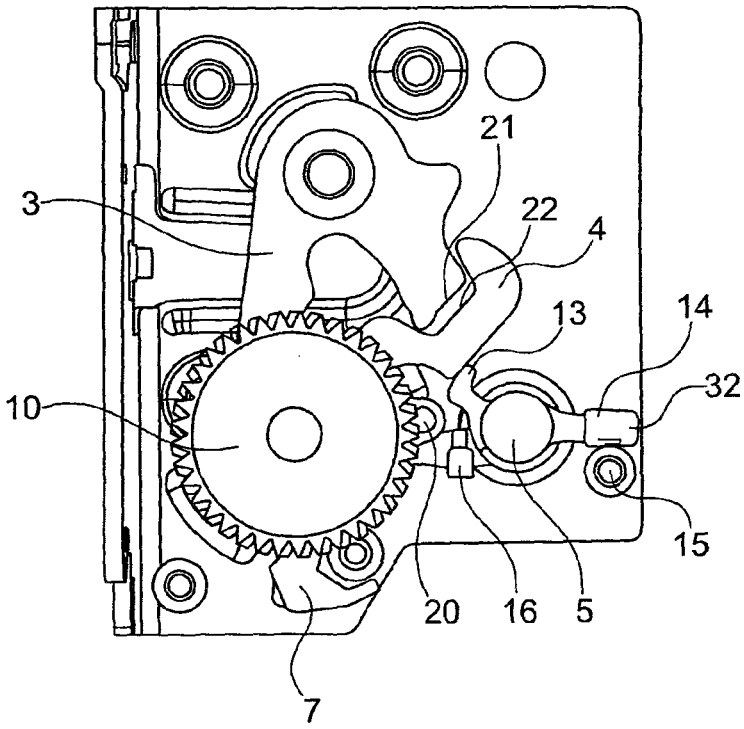
FIG. 3 shows a partial view of the embodiment of FIG. 1 in the closed position.

FIG. 3 shows the locking device 1 of FIG. 1 with certain particular parts of the actuator omitted to more clearly show the second pawl 5. In particular, it can be seen here that the catch 3 is implemented with the projection 21, which engages in the U-shaped recess 22 of the first pawl 4. To block the opening rotation of the catch 3 and the first pawl 4, the second pawl 5 with its blocking leg 13 abuts against the first pawl 4 across from the catch 3. In this way, the position of the catch 3 or the first pawl 4 is thus secured.

The second pawl 5 comprises two additional legs. The stop leg 14, which rests here against the pivot limiter 15, defines the exact position of the blocking leg 13 with respect to the first pawl 4. As is evident from this, the stop leg 14 comprises damping material 32 at its periphery in order to realize a quiet impact with the pivot limiter 15. Opposite the stop leg 14, is a driver leg 16, which is also partially encapsulated by a cushioning material. This driver leg 16 interacts in particular with the drive pin 20 of the operating lever 7, which is indicated here below the drive wheel 10. Preferably, the drive pin 20 of the operating lever 7 contacts, in the closed or locked position, the driver leg 16 of the second pawl 5.

Figure 4:
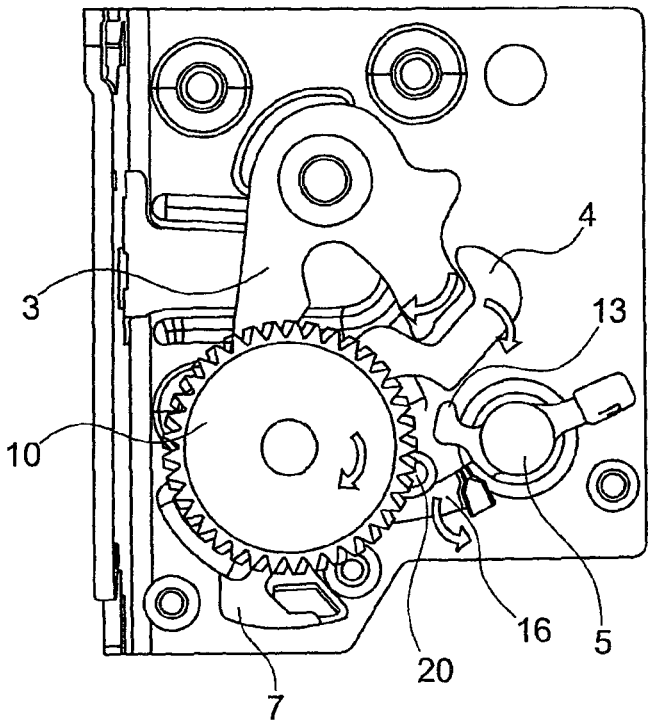
FIG. 4 shows the locking device of FIG. 3 during the opening movement.

FIG. 4 shows the beginning of the opening movement. The actuator (not shown here) is activated and the drive wheel 10 turns in a clockwise direction. The operating lever 7 also pivots about the drive pin 20 in a clockwise direction. Because of this rotational movement, the drive pin 20 pushes the driving leg 16 of the second pawl 5 in the counterclockwise direction around its pivot point. This will automatically break the contact between the blocking leg 13 and the second pawl 5. Because of the moment produced by the catch 3 and the pawl 4, this leads to pivoting of the first pawl 4 counterclockwise and to an opening movement of the catch in the clockwise direction.

Figure 5:
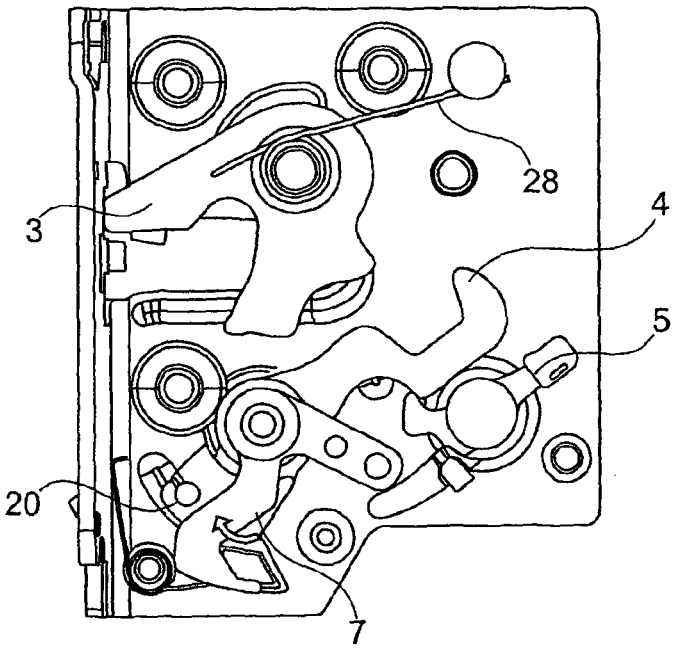
FIG. 5 shows the locking device of FIG. 4 in an open position in the case of a low reset force applied to the catch.

The first pawl 4 is deflected to different degrees depending on the strength of the moment of the catch 3 that is created via the corresponding spring element 28 (shown in FIGS. 5 and 6) and/or by the external seals, pads, etc. FIG. 5 shows the case in which the restoring moment of the catch 3 is small and FIG. 6 shows the case in which the restoring moment is large.

The lower part of FIG. 5 shows the position of the locking mechanism in the case of a small return moment for the catch 3. In this way, the first pawl 4 is moved via the operating lever 7, which is pivoted by the drive wheel 10, into a desired position. This happens because the operating lever 7 is brought into contact with the drive pin 20 of the first pawl 4. In this way, the first pawl 4 is pivoted by the drive pin 20 due to the driven movement of the operating lever 7 (provided with a damping material). In the version shown here, the operating lever 7 steers both the first pawl 4 and the second pawl 5 toward the end of the opening movement, and the movement of the first pawl 4 occurs later in time.

Figure 6:
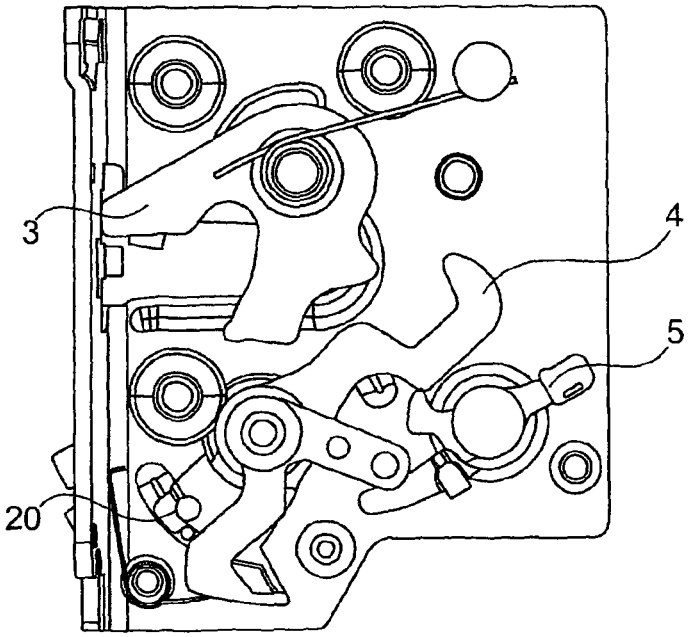
FIG. 6 shows the locking device of FIG. 4 in the case of a high reset force applied to the catch.

FIG. 6 shows the situation, in which (in exceptional cases or when the seat is new) relatively high reset moments of the catch 3 persist, and thus, exert a large force on the first pawl 4. In this case, the first pawl 4 is so far deflected by the catch 3 that there is no need to move the first pawl 4 by the operating lever 7, and/or this movement can be retarded or delayed. This means, for example, that a larger pivoting path may be realized by the operating lever, until the operating lever, where appropriate, comes into contact with the drive pin 20 of the first pawl 4.

Figure 7:
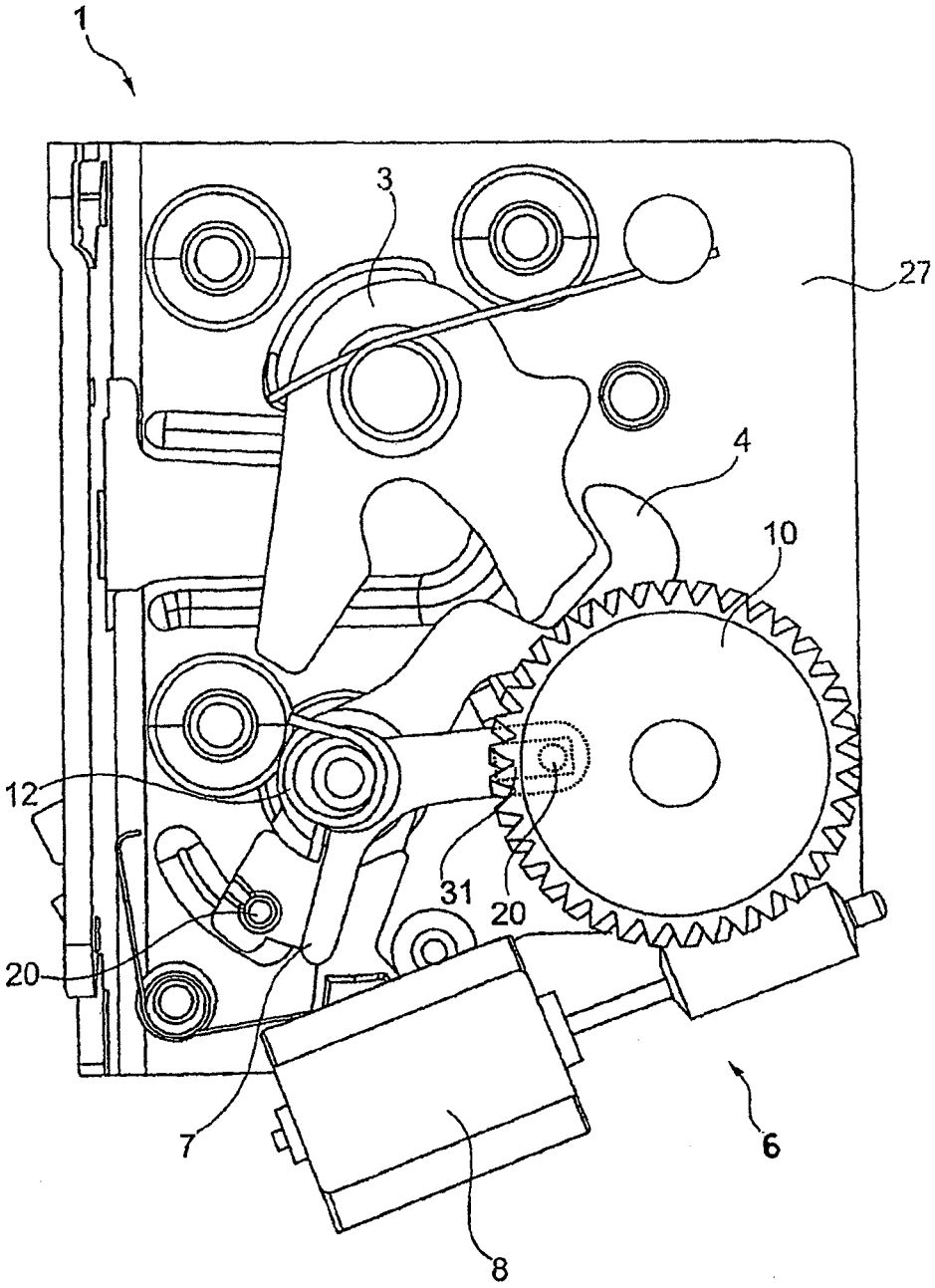
FIG. 7 shows a further embodiment of the locking device.

FIG. 7 shows the closed position of another embodiment of the locking device 1. Shown again is the bottom plate of the housing 27, on which are mounted the catch 3, the first pawl 4 and the second pawl 5 (hidden by the drive wheel 10 of the actuator 6). The position of the locking mechanism 2 is substantially the same as the starting position of the locking device in FIG. 1.

One difference, however, should be noted with respect to the location of the actuator 6 and the positioning of the actuator 6 and the operating lever 7. Even if, in this embodiment, the division into the three levels is retained, the drive wheel 10 here is mounted on the same axis as is the second pawl 5. The operating lever 7 is, nevertheless, mounted on the rotational axis of the first pawl 4 and is biased by the reset spring 12. If the locking device 1 is to be opened, the electric motor 8 sets the drive wheel 10 in motion so that the drive wheel 10 moves counterclockwise. Here, a drive pin 20 is formed, which is guided in the guide 31 of the operating lever 7. The second pawl 5 is then first moved counterclockwise about the drive pin 20 or the release lever 7 so that the second pawl 5 releases the first pawl 4. In this case, the catch 3 opens the first pawl 4 at least partially due to the restoring moment so that the first pawl 4 is pivoted clockwise. Depending on the strength of the restoring moment and the pivoting path of the first pawl 4, where appropriate, a specific articulation is required of the first pawl 4 by the operating lever 7. This occurs when the drive wheel 10 is further rotated counterclockwise and the operating lever 7 comes in contact with the drive pin 20 of the first pawl 4.

Figure 8:
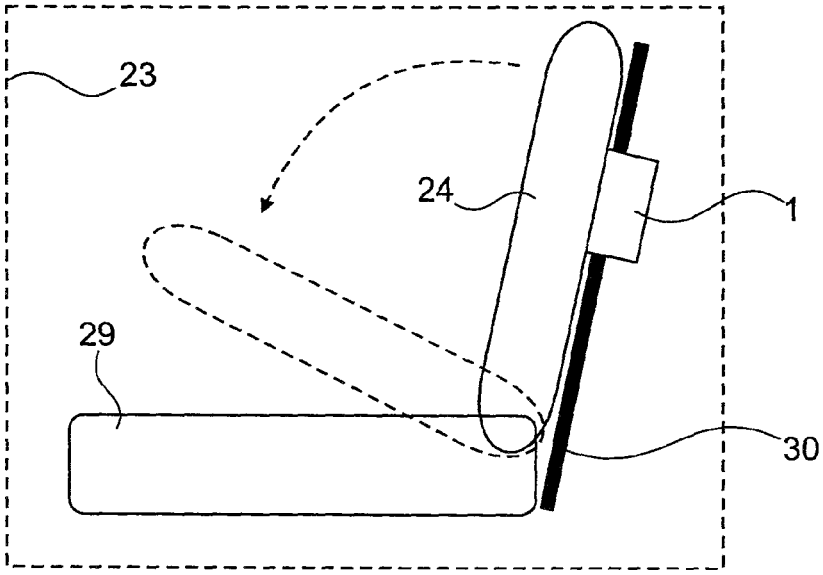
FIG. 8 shows a motor vehicle with a seat.

As mentioned above, the locking device is preferably used as a locking system for the locking and unlocking of seat backrests in motor vehicles, especially for folding seat backs of the rear seats. This is illustrated in FIG. 8. FIG. 8 shows a schematic of a motor vehicle 23 with a seat 29. The back 24 of the seat 29 is pivoted or folded (dotted position). This is performed only at the desired time points. The back 24 is fixed by means of the locking device 1, described herein according to the invention, to one (or more) fastening member(s) 30, for example, to a component of the body of the vehicle 23. The latch pin can be attached either to the back 24 or the fastening member 30, as is the case with the locking device. It is also possible for several such locking devices 1 to be provided with respect to one such seat 29.

REFERENCE LIST

1. Locking device
2. Locking mechanism
3. Catch
4. First pawl
5. Second pawl
6. Actuator
7. Operating lever
8. Electric motor
9. Output shaft
10. Drive wheel
11. Bearing
12. Return spring
13. Blocking leg
14. Stop leg
15. Pivot limiter
16. Driver leg
17. First level
18. Second level
19. Third level
20. Drive pin
21. Projection
22. Recess
23. Motor vehicle
24. Back rest
25. Inlet
26. Latch pin
27. Housing
28. Spring element
29. Seat
30. Fastening member
31. Guide
32. Damping material

The invention claimed is:

1. A locking device comprising a locking mechanism including a catch movable between an open position and a closed position, a pivotal first pawl movable between a latching position for holding the catch in the closed position and a release position for releasing the catch so that it can move toward its open position, and a second pawl movable between a blocking position preventing movement of the first pawl out of its latching position and an unblocking position allowing the first pawl to move out of its latching position for releasing the catch, and a motor-driven actuator, and said motor-driven actuator actuates an operating lever such that said operating lever cooperates during its movement with the second and first pawls in succession;

wherein the second pawl is in contact with the first pawl in the blocking position, and the second pawl is not in contact with the first pawl in the unblocking position; and wherein said second pawl comprises three legs including a blocking leg for said first pawl, a stop leg for a pivoting limiter, and a driver leg for said operating lever, wherein the three legs extend outward from a central portion of the second pawl.

2. The locking device of claim 1, wherein the actuator comprises an electric motor with an output shaft, and a drive wheel cooperating with said output shaft.

3. The locking device of claim 2, wherein the drive wheel forms a common bearing with said first pawl or said second pawl.

4. The locking device of claim 3, wherein said drive wheel and said operating lever rotate in a common direction.

5. The locking device of claim 2, wherein said drive wheel and said operating lever rotate in a common direction.

6. The locking device of claim 2, wherein said drive wheel is equipped with a reset spring.

7. The locking device of claim 1, wherein said operating lever is plastic.

8. The locking device of claim 1, wherein said locking mechanism is disposed on a first plane, said operating lever is disposed on a second plane, and said actuator is disposed on a third plane, and components disposed on adjacent planes interact by means of at least one drive pin.

9. The locking device of claim 1, wherein said operating lever and said first pawl have a common bearing.

10. The locking device of claim 1, wherein said catch comprises a projection, and said first pawl comprises a recess for receiving said projection.

11. A motor vehicle comprising a seat with a folding back rest, wherein said back rest is lockable in a position by means of the locking device of claim 1.

12. The locking device of claim 1, wherein the actuator comprises an electric motor with an output shaft, and a drive wheel cooperating with said output shaft; the drive wheel forms a common bearing with said first pawl or said second pawl; said locking mechanism is disposed on a first plane, said operating lever is disposed on a second plane, and said actuator is disposed on a third plane, and components disposed on adjacent planes interact by means of at least one drive pin.

13. The locking device of claim 12, wherein said drive wheel and said operating lever rotate in a common direction.

14. The locking device of claim 12, wherein said drive wheel is equipped with a reset spring.

15. The locking device claim 12, wherein said operating lever is plastic.

16. The locking device of claim 12, wherein said operating lever and said first pawl have a common bearing.

17. The locking device of claim 12, wherein said catch comprises a projection, and said first pawl comprises a recess for receiving said projection.

18. A motor vehicle comprising a seat with a folding back rest, wherein said back rest is lockable in a position by means of the locking device of claim 12.

* * * * *